US005185774A

United States Patent [19]

Klostermann

[11] Patent Number: 5,185,774

[45] Date of Patent: Feb. 9, 1993

[54] X-RAY TUBE CONSTRUCTION

[75] Inventor: Heinrich F. Klostermann, Menlo Park, Calif.

[73] Assignee: PXT Technology, Inc., Palo Alto, Calif.

[21] Appl. No.: 617,191

[22] Filed: Nov. 23, 1990

[51] Int. Cl.[5] ..... H01J 35/10

[52] U.S. Cl. ..... 378/125; 378/127; 378/132; 378/141; 378/144

[58] Field of Search ..... 378/125, 132, 130, 127, 378/133, 141, 144

[56] References Cited

U.S. PATENT DOCUMENTS

| | | | |
|---|---|---|---|
| 4,210,371 | 6/1980 | Gerkema et al. | 378/133 |
| 4,405,876 | 9/1983 | Iversen | 378/130 |
| 4,569,070 | 2/1986 | Schubert et al. | 378/132 |
| 4,635,283 | 1/1987 | Starek et al. | 378/132 |
| 4,841,557 | 6/1989 | Haberreck et al. | 378/127 |
| 4,949,368 | 8/1990 | Kubo | 378/132 |
| 4,949,369 | 8/1990 | Bittl | 378/127 |
| 4,964,148 | 10/1990 | Klostermann et al. | 378/127 |
| 4,993,055 | 2/1991 | Rand et al. | 378/125 |

*Primary Examiner*—Constantine Hannaher
*Assistant Examiner*—Kim-Kwok Chu
*Attorney, Agent, or Firm*—Flehr, Hohbach, Test, Albritton & Herbert

[57] ABSTRACT

An x-ray tube construction comprising a housing and a shaft assembly mounted within the housing for rotational movement within the housing. An anode target is provided in the housing. A three-ball mounting is provided for mounting the anode target on the shaft assembly so that the anode target rotates with the shaft assembly. A cathode is disposed within the housing in the vicinity of the anode target. A voltage supply is connected to the anode target and to the cathode for accelerating electrons from the cathode to impinge upon the anode target to create x-rays. The three-ball mounting serves to minimize the transfer of heat from anode target to the shaft assembly. A motor drive is coupled to the shaft assembly for rotating the shaft assembly and the anode target carried thereby. A heat cage is disposed within the housing and surrounds the anode target. The heat cage has a window therein to permit the x-rays to pass therethrough. A vacuum envelope is mounted within a housing and serves to provide a vacuum-tight enclosure for the anode target and the cathode. The vacuum envelope includes a window in registration with the window in the heat cage to permit x-rays to pass therethrough.

26 Claims, 6 Drawing Sheets

X-RAY TUBE CONSTRUCTION

This invention relates to an x-ray tube construction and more particularly to a high power x-ray tube construction which can be either air cooled or liquid cooled.

X-ray tubes have heretofore been provided. One x-ray tube construction is disclosed in U.S. Pat. No. 4,964,148. However, it has been found that such an x-ray tube has limited power capabilities. There is a need therefore for a new and improved x-ray tube construction which has greater power handling capabilities.

In general, it is an object of the present invention to provide an x-ray tube construction which has high power capabilities.

Another object of the invention is to provide x-ray tube construction of the above character which can be air cooled.

Another object of the invention is to provide an x-ray tube construction of the above character which can be liquid cooled.

Another object of the invention is to provide an x-ray tube construction of the above-character which can accommodate very high anode temperatures.

Another object of the invention is to provide an x-ray tube of the above character which has a shaft construction which can withstand ultra high anode temperatures.

Additional objects of the present invention will appear from the following description of the preferred embodiment set forth in detail in conjunction with the accompanying drawings.

Figure 1:
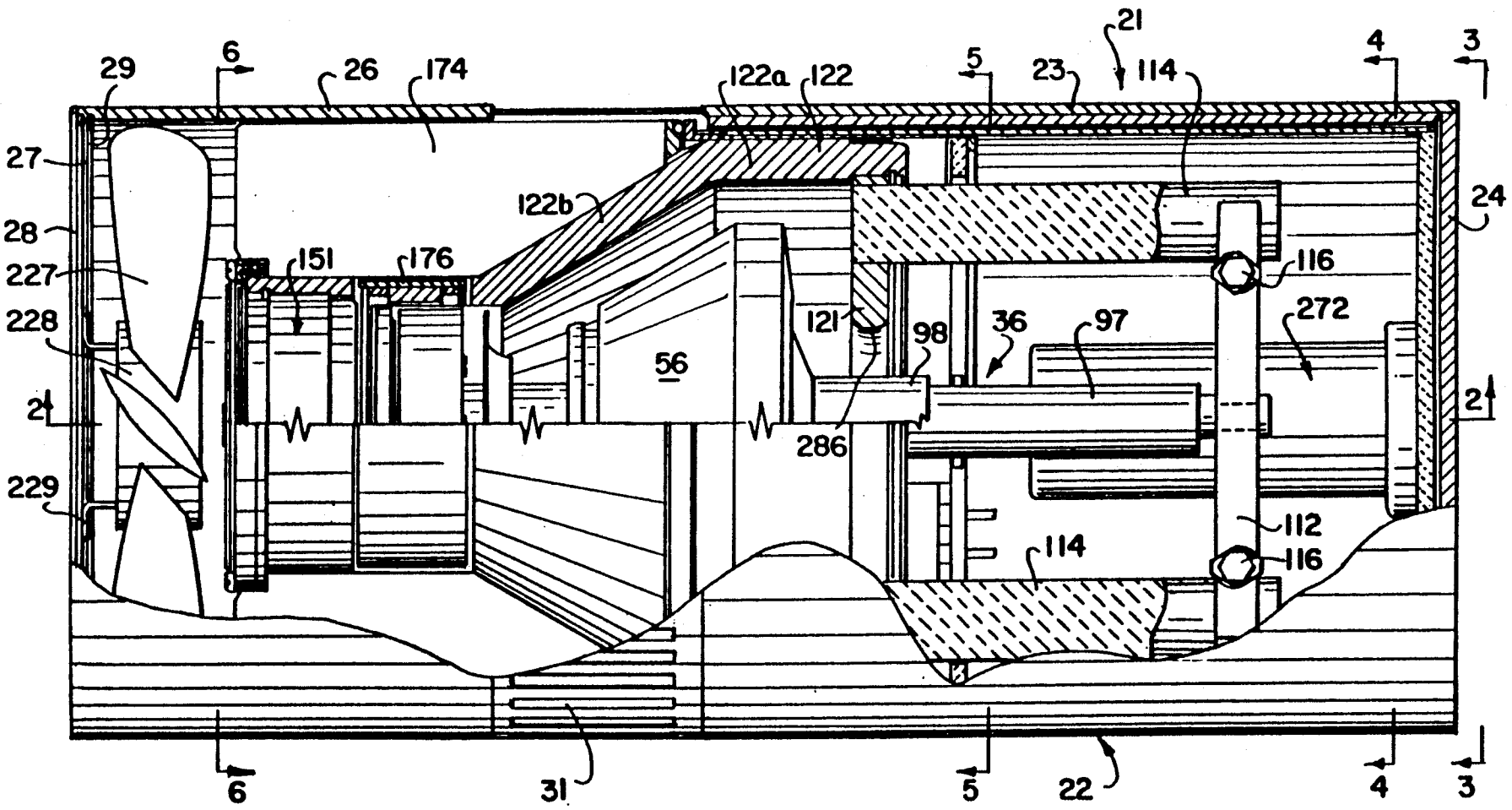
FIG. 1 is a side elevational view of an x-ray tube construction incorporated in the present invention.

In general, the x-ray tube construction of the present invention is comprised of a housing. A shaft assembly is mounted within the housing for rotation therein. An anode target is disposed within the housing. Three-point mounting means is provided within the housing for mounting the anode target on the shaft assembly so that the anode target rotates with the shaft. A cathode for supplying electrons is disposed within the housing in the vicinity of the anode target. Voltage means is connected to the anode target and to the cathode for accelerating electrons from the cathode to impinge upon the anode target to create x-rays. The three-point mounting means serves to minimize the transfer of heat from the anode target to the shaft assembly. Motor drive means is coupled to the shaft assembly for rotating the shaft assembly and the anode target. A heat cage is disposed within the housing and surrounds the anode target and is provided with a window therein to permit the x-rays to pass therethrough. The housing includes means for maintaining a vacuum surrounding the anode target and the cathode.

As shown more particularly in the FIGS. 1–17 of the drawings, the x-ray tube construction 21 of the present invention consists of a cylindrical housing member 22 formed of suitable material such as aluminum. The housing 22 is comprised of a first cylinder 23 which is open at one end and has a circular plate 24 closing the other end. The housing 22 also consists of a second cylinder 26 which also is open at one end and which has a screen 27 mounted at the other end and retained therein by first and second C-rings 28 and 29 mounted on opposite sides of the screen 27. The housing 22 also includes a cylindrical grill 31 disposed between and secured to the cylindrical members or cylinders 23 and 26.

Figure 15:
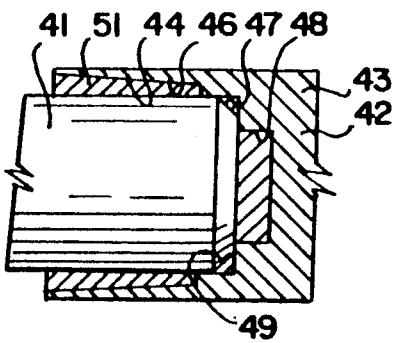
FIG. 15 is a partial cross-sectional view showing the mounting for the ceramic part of the shaft utilized in the x-ray tube construction of the present invention.
Figure 14:
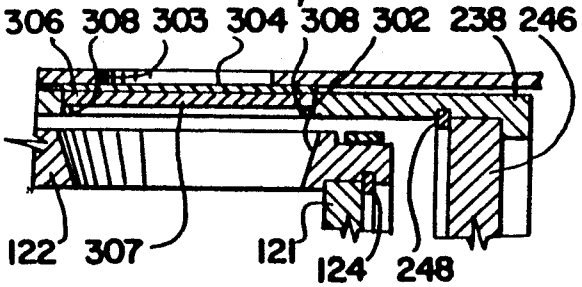
FIG. 14 is a partial cross-sectional view showing the window construction utilized in the x-ray tube construction of the present invention.

A shaft assembly 36 is rotatably mounted in the housing 22 by first and second ball bearing assemblies 37 and 38. The shaft assembly 36 consists of a cylindrical part 41 formed of suitable ceramic such as aluminum oxide which can have suitable dimensions, as for example a diameter of one inch and a length of four inches. The shaft assembly 36 also consists of a metallic inner shaft 42 formed of a suitable material such as stainless steel no. 416. The inner shaft 42 is provided with an enlarged cup-shaped portion 43 (see FIGS. 2 and 14). The cup-shaped portion of 43 is provided with a tapered cup-shaped recess 44 formed by an outwardly inclined wall 46. The cup-shaped portion 43 is also provided with a smaller cylindrical bore 47 which opens into the recess 46 and a still smaller bore 48 which opens in the bore 47. As can be seen in FIG. 15, the ceramic shaft part 41 seats within the bore 47. The ceramic shaft 41 is provided with a chamfer 49.

Means is provided for forming a bond between the stainless steel shaft 42 with its cup-shaped portion 43 and the ceramic shaft 41. One means found to be particularly satisfactory has been the use of copper foil which is wrapped around the ceramic shaft 41 and then inserting the shaft with the foil thereon into the recess 44. The assembly is then heated to a temperature as for example 1200° C. to melt the copper foil to form a molten bath 51 of copper which surrounds the ceramic shaft part 41 and passes the chamfer 49 to fill the bore 48. Upon cooling, the copper hardens and forms an excellent bond between the ceramic shaft part 41 and the metallic shaft cup-shaped portion 43. It has been found that the use of these materials is particularly efficacious because the stainless steel has a coefficient of expansion which is greater than that of the ceramic shaft part 41 and less than that of the copper. Thus, upon cooling, the copper 51 will harden and cup-shaped portion 43 will decrease in diameter at a more rapid rate than the ceramic shaft 41 so as to place the copper under compression and to form an excellent bond between the ceramic shaft 41 and the metallic portion 43. In addition to forming an excellent bond, the soft copper also serves as a cushion for the ceramic shaft part 41.

An anode target 56 is mounted within the housing 22 and is formed of a suitable material such as molybedenum. It is provided that with an inclined surface 57 formed of rhenium tungsten material It is inclined at a slight angle from the horizontal for purposes hereinafter described.

A three-point or tri-point mounting means 58 (see FIG. 9) is provided for mounting the anode target 56 on the shaft assembly 36 so that it will rotate therewith. As hereinafter described, this three-point mounting means is comprised of a plurality of sets of three balls each with the balls providing only three-point contact for the transmission of heat to thereby minimize the transfer of heat from the anode target 56 to the shaft assembly 36.

In order to accommodate this three-point mounting means 58, the anode target 56 has been provided with a large cylindrical recess 61 which opens in a direction away from the surface 57. The balls of the sets of balls are formed of a heat-stop material which minimizes transfer of heat so that they can serve as heat stops. Typically they can be formed of zirconia or, alternatively, of niobium.

The first set 62 of balls consists of three balls 63 of relatively large diameter spaced 120° apart. The balls 63 are seated in moon-shaped recesses 64 which are formed in a cylindrical base support 66. The base support 66 is also formed of a suitable material to minimize heat transfer, such as zirconia. The three balls 63 are adapted to seat in the right-angle circular corner of the cylindrical recess 61. The circular base support 66 is mounted on a cup-shaped member 67 of No. 304 stainless which is mounted coaxially on the cup-shaped portion 43 of the metallic shaft 42 and is bonded to a ring 68 formed of a suitable heat insulating material such as zirconia. A second set 69 of three balls 71 are also spaced 120° apart and are carried by the cup-shaped member 67 and engage the cup-shaped portion 43 of the metallic shaft 42. A third set 72 of three balls 73 also spaced 120° apart are provided between the base support 66 and a bottom cap or ring 76 to provide additional heat isolation. Three sleeves also spaced 120° apart and offset by 60° from the balls are rotatably mounted in the base support 66 and have eccentric flanges 78 which are adapted to engage the balls 71. Push screws 81 are threaded into the sleeves 77 and have rounded extremities 82 to adapt it to engage the balls 63. Lock screws 83 are provided in each of the sleeves 77 to lock the push screws 81 in position. The sleeves 77 are provided with screw-driver slots 84 to permit rotational adjustment of the same to center the anode target with respect to the shaft assembly 36. The push screws 81 can be adjusted to level the anode target 56.

The three-point mounting means 58 for the anode target 56 also includes a conical support ring 86 which mates with the anode target 56 and of a fourth set 87 of balls 88 which are also spaced 120° apart add which are seated in moon-shaped recesses in conical support ring 86 and the anode target 56 so that the only contact between anode target 56 and the support ring is through the balls 88. The balls 88 serve as heat stops because they are formed of suitable material such as zirconia and in addition they only provide point contact between the surfaces that they engage.

The other extremity of the support ring 86 engages a linear bearing structure 91 which consists of a linear bearing sleeve 92 that carries first and second longitudinally spaced apart sets 93 and 94 of three balls 96 each spaced 120° apart. The balls 96 are carried by the sleeve 92 and engage the outer surface of the inner metal shaft 42 and the inner surface of the outer sleeve or shaft 97. The sleeves 92 and 97 are formed of a suitable material such as stainless steel No. 416 alternatively they can be formed of a ceramic material such as zirconia. Linear bearing sleeve 98 is secured to the conical support ring 86. A heat shield sleeve 98 formed of a suitable material such as molybdenum is also secured to the conical support ring 86 and extends longitudinally therefrom to cover the space between the left hand of the sleeve or outer shaft 97 and the linear bearing sleeve 92. The other end of the outer shaft 97 is secured to the outer race of ball bearing assembly 38. A large helical spring 101 is disposed within the outer shaft 97 and has one end engaging the ball bearing assembly 38 and has the other end engaging a flanged ring 102 mounted on the end of the linear bearing sleeve 92.

A stationary shaft 106 formed of a suitable material such as No. 304 stainless steel is mounted in the inner race of ball bearing assembly 38 and is aligned with the inner metal shaft 42 but is spaced therefrom. A helical compression spring 107 is mounted on the shaft 106 and has one end engaging a C-ring 108 secured to the shaft 106 and has the other end in engagement with the a split crossbar 112 which engages the inner race of the ball bearing assembly 38. Another helical compression spring 111 is mounted on the shaft 106 and has one end engaging the opposite side of the inner race of the ball bearing assembly 38 engaged by the spring 107 and has the other end engaging the split cross bar 112. The spring 107 is seated in an annular recess 113 into which the shaft 106 extends. The split cross bar 112 is provided with two parts **112*a* and 112*b* (see FIG. 4), which are provided with slots 113 to permit the extremities of the cross bar 112 to be clamped onto posts 114 formed of suitable insulating material such as a ceramic by the use of clamping screws 116 (see FIG. 1**).

The posts 114 are mounted in the copper cross plate 121 mounted in the heat cage 122. The cross plate 121 is formed of two parts **121*a* and 121*b* mounted on one end of a relatively massive generally cup-shaped heat cage 122 formed of a suitable material such as copper. As can be seen from FIGS. 1 and 2, the heat cage 122 is of a size so that it surrounds the anode target 56. The heat cage 122 consists of a cylindrical portion 122*a* which adjoins a conical portion 122*b*. The cylindrical portion 122*a* is provided with an annular recess 123 which receives the cross plate 121 and which is retained therein by suitable means such as a C-ring 124. In order to ensure intimate contact between the cross plate 121** and the cylindrical portion 122*a* of the heat cage 122, yieldable means in the form of a spring 126 (see FIG. 13) is provided between the two parts 121*a* and 121*b* to urge them radially to establish close and intimate contact with the cylindrical portion 122*a* of the heat cage 122 to provide good heat transfer.

Figure 2:
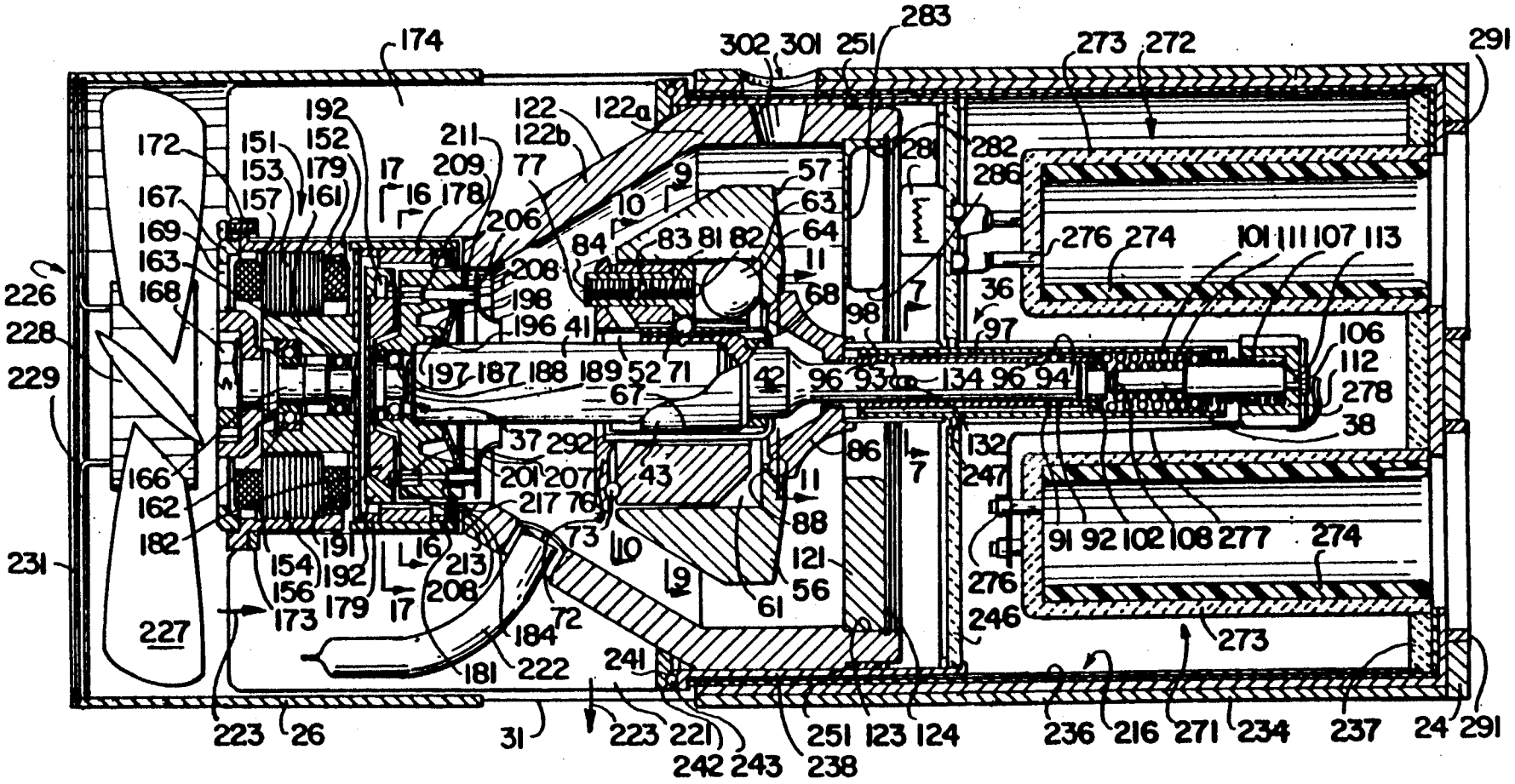
FIG. 2 is a cross-sectional view taken along the line 2—2 of FIG. 1.
Figure 4:
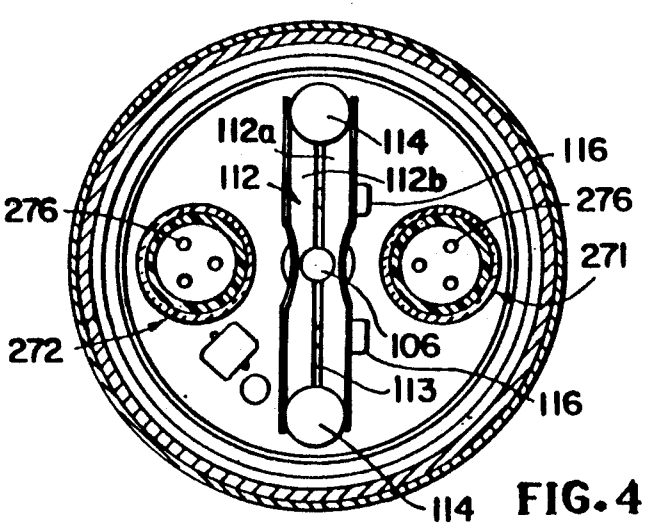
FIG. 4 is a cross-sectional view looking along the line 4—4 of FIG. 1.
Figure 6:
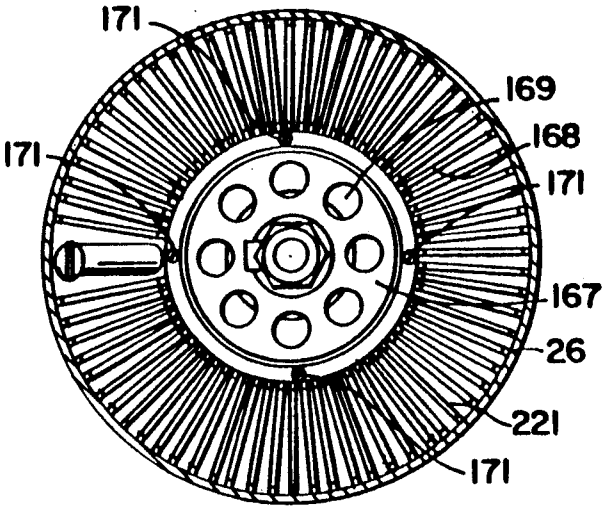
FIG. 6 is a cross-sectional view taken along the line 6—6 of FIG. 1.
Figure 3:
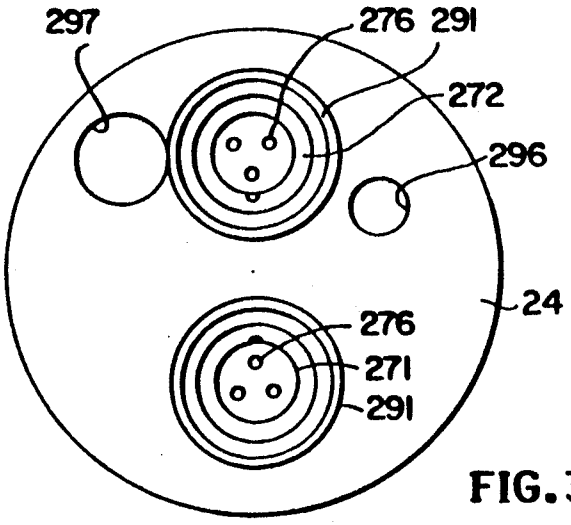
FIG. 3 is an end elevational view taken along the line 3—3 of FIG. 1.
Figure 5:
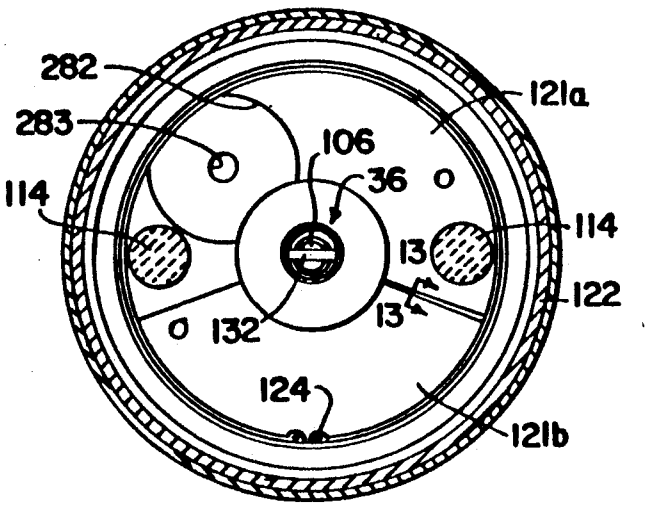
FIG. 5 is a cross-sectional view taken along the line 5—5 of FIG. 1.
Figure 9:
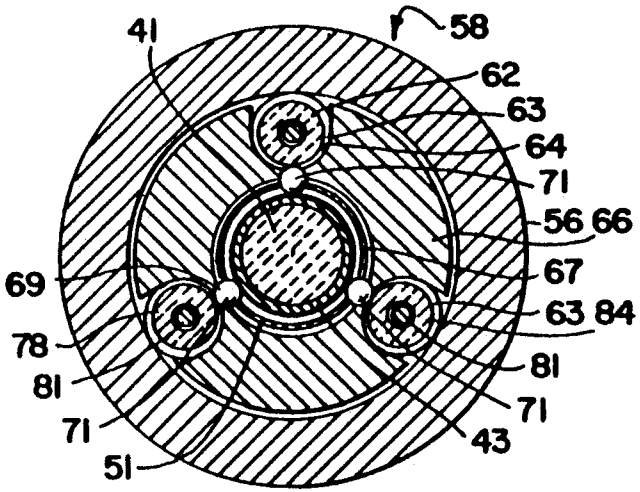
FIG. 9 is a cross-sectional view taken along the line 9—9 of FIG. 2.
Figure 12:
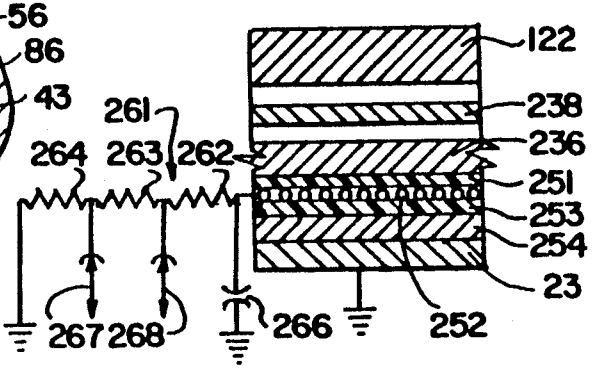
FIG. 12 is an enlarged cross-sectional view of a portion of the housing wall construction utilized in the x-ray tube construction.
Figure 8:
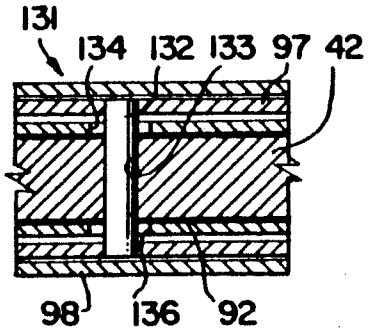
FIG. 8 is a cross-sectional view taken along the line 8—8 of FIG. 7.
Figure 11:
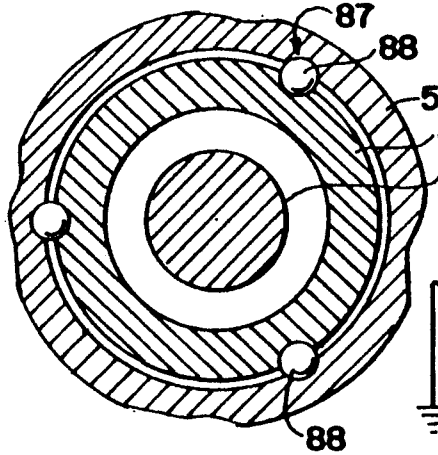
FIG. 11 is a cross-sectional view taken along the line 11—11 of FIG. 2.
Figure 7:
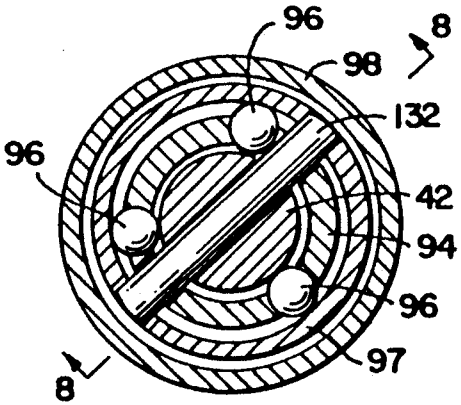
FIG. 7 is a cross-sectional view taken along the line 7—7 of FIG. 2.
Figure 10:
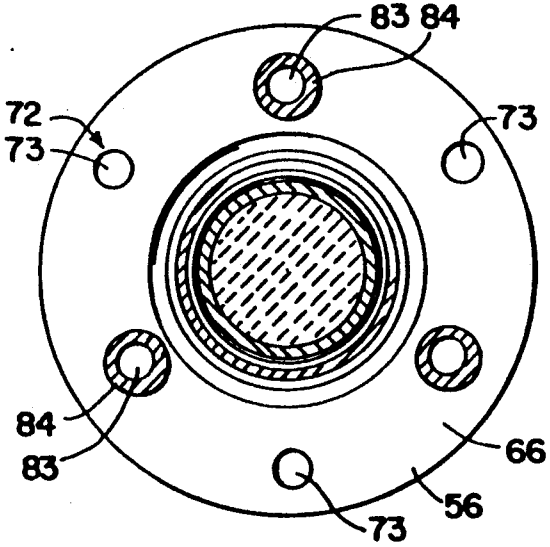
FIG. 10 is a cross-sectional view taken along the line 10—10 of FIG. 2.
Figure 13:
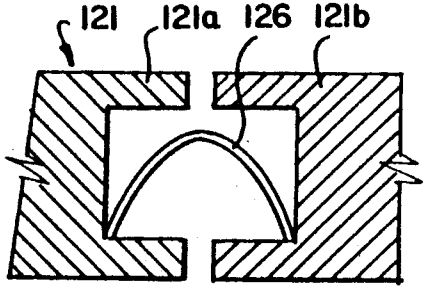
FIG. 13 is a cross-sectional view taken along the line 13—13 of FIG. 5.

A pin assembly 131 is provided for interconnecting the inner shaft 42 and the outer shaft 97 and permits longitudinal movement between the same to accommodate expansion and contraction during heating and cooling of the x-ray tube 21. The pin assembly 131 is shown particularly in FIG. 8 and includes a pin 132 which extends diametrically of the inner shaft 42 through a hole 133 provided in the shaft. The pin 132 extends through long elongate slots 134 provided in the linear bearing sleeve 92 and short elongate slots 136 provided in the outer shaft 97. Thus, it can be seen that when the large compression spring 101 applies a force on the outer race of the ball bearing assembly 38, this causes linear bearing sleeve 97 to move to the right as shown in FIGS. 2 and 8. This in turn causes the inner shaft 42 to be moved to the right as viewed in FIG. 8, while at the same time permitting relative longitudinal movement of the linear bearing sleeve 92 because of the long slots 134 provided therein. The heat shield sleeve 98 serves to prevent the pin 132 from accidently slipping out of the hole 133 provided in the shaft 42.

Motor drive means 151 is coupled to the shaft assembly 36 for rotating the shaft assembly 36 and the anode target 56 mounted thereon. The motor drive assembly 151 consists of a cylindrical motor housing 152 formed of a suitable insulating material such as plastic. The motor drive assembly also includes a stator 153 mounted within the housing 152. The stator 153 is comprised of a winding 154 provided on an iron core 156, which is retained within the housing 152 by a C-ring 157. The stator 153 drives a squirrel-cage rotor 161 which is mounted on outer races of first and second ball bearing assemblies 162 and 163. The inner races of the ball bearing assemblies 162 and 163 are mounted upon a stationary shaft 166. The shaft 166 is mounted in and secured to and end plate 167 by a nut 168 (see FIGS. 2 and 6). The end plate 167 is formed of a suitable insulating material such as plastic. A plurality of circumferentially spaced ventilating holes 169 are provided in the end plate 167 to permit the entrance of air for the motor drive means 151. The motor housing 152 and the endplate 167 are secured by circumferentially spaced screws 171 extending through a flange 172 on the housing 152 and threaded into a ring 173 of stainless steel No. 304. The ring 173 is brazed to a plurality of spaced apart radially extending copper fins 174. The copper fins 174 are also brazed to the exterior surface of the heat cage 122.

Figure 16:
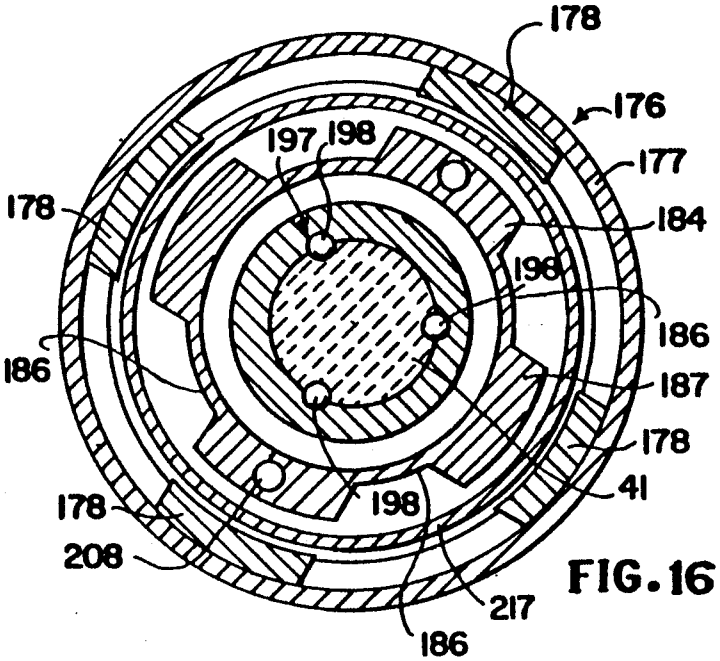
FIG. 16 is a cross-sectional view taken along the line 16—16 of FIG. 2.

A magnetic drive assembly 176 is provided for transferring rotational forces from the motor drive means 151 to the shaft assembly 36 and consists of a rotatable cylindrical member 177 of magnetic stainless steel No. 416 which has a plurality of permanent magnets 178 mounted thereon by suitable means such as an adhesive (see FIGS. 2 and 16). Four of such magnets 178 are provided and are spaced apart by 90°. Spacer rings 179 and 181 of a non-magnetic material such as plastic or stainless steel No. 304 are disposed on opposite sides of the magnets 178 and are disposed adjacent the cylindrical member 177 and travel with the cylindrical member 177. The rotatable cylindrical member 177 is mounted upon and secured to a circular plate 182 of stainless steel No. 416 which is secured to the rotor 161 of the motor drive means 151.

The magnetic drive assembly 176 also includes a magnetic rotor 184 formed of a suitable magnetic material such as stainless steel No. 416. The rotor 184 is provided with arcuate recesses 186 which are circumferentially spaced 90° apart so that lobes 187 therebetween can register with the magnets 178. The rotor 184 is carried by the outer race of a ball bearing assembly 188. The inner race of the ball bearing assembly 188 is secured to a stub shaft 189. The stub shaft 189 is mounted upon and is formed integral with a stationary cup-shaped member or shaft plate 191 formed of stainless steel No. 304. The cup-shaped member 191 is adapted to be moved into a latched or locked position with respect to stationary end plate 192. Cooperative latching means in the form of pin and recess is provided and consists of a plurality of spaced apart radially extending pins 193 carried by the shaft plate 191 which are adapted to enter slots or recesses 194 provided in a radially extending flange 195 of the end plate 192. By pushing downwardly on the member 191 to push the pins 193 into the slots 194 and twisting the member 191, the pins 193 can be brought into recesses 196 under the flange 195 to secure the shaft 189 in a fixed longitudinal position.

The cylindrical shaft part 41 of the shaft assembly 36 is mounted in the magnetic rotor 184 so that it rotates therewith. This is accomplished by use of a set of three balls 197 which are spaced 120° apart and which engage dish-shaped dimples 198 provided in the ceramic part 141 and seated in dish-shaped recesses 178 provided in the magnetic rotor 184.

A circular spring washer 201, commonly called a Bellville washer, is mounted within the rotor 184 and is retained therein by a C-ring 202. The washer 201 engages the ceramic shaft part 41 and retains it within the rotor 184.

A circular heat shield and push plate 206 of stainless steel No. 304 is provided and has a flanged opening 207 to accommodate the ceramic part 41 of the shaft assembly 36.

Suitable means is provided for supporting the heat shield and push plate 206 on the magnetic rotor 184 and consists of a plurality of circumferentially spaced upstanding pins 208 which are brazed to the heat shield 206. The pins 208 are slidably mounted in the rotor 184 and are retained therein by C-rings 209. Springs 211 are mounted on the pins 208 and are seated in wells 212 in the rotor 184 and serve to retain the heat shield 206 in an elevated position, separated from the magnetic rotor 184. When the heat shield 206 is depressed when used as a push plate, the pins 208 extend through the rotor 184 and are adapted to seat in holes 213 provided in the cup-shaped member or shaft plate 191 to cause rotation of the shaft plate 191 to move the pins 193 into engagement with or disengagement from the flange 195. The push plate 191 is adapted to be engaged by a tool (not shown) which can be inserted into the heat cage 122 between the heat cage 122 and the anode target 56. The tool then can be rotated to rotate the shaft plate 191 to operate the cooperative latching means compresing the pins 193 and the slots 194 so that the shaft assembly 36 with the anode target 56 and the rotor 184 can be inserted and removed as a unit.

Vacuum envelope means 216 is provided within the housing 22 for maintaining a vacuum surrounding the anode target 56. This vacuum envelope means 216 includes a cylindrical member 217 formed of a suitable material such as stainless steel No. 304 which has one end bonded to the heat cage 122 to form a vacuum-tight seal therebetween while the other end is similarly bonded to the ring 192. Magnetic forces generated by the rotating magnets 178 pass through the cylindrical member 217 and act upon the magnetic rotor 184 to cause the rotation of the shaft assembly 36. The heat cage 122 forms a part of the vacuum envelope means 216. A pinch-off tube 222 for evacuating the vacuum envelope means 216 extends into the heat cage 122 and between the fins 174.

Cooling means is provided which is in communication with the housing for directing a cooling fluid over the fins 174 and the heat cage 122. In the emodiment shown in FIGS. 1–17, cooling means is provided within the housing for forcing air past the cooling fins 174 and out through the grill 31 as indicated by the arrows 223 (see FIG. 2). Such cooling means consists of a fan 226 having vanes 227 and a drive motor 228. The fan motor 228 is supported by legs 229 mounted upon the screen 28 carried by the cylindrical member 26.

The vacuum envelope means 216 also consists of a cylindrical member 236 formed of a suitable material, such as stainless steel No. 304, which is bonded to an end plate 237 formed of a suitable ceramic, such as aluminum oxide ($Al_2O_3$), by suitable means such as metallizing and brazing to form a vacuum-tight seal. The other end of the cylindrical member 236 is bonded to another cylindrical member 238, also formed of a suitable material such as stainless steel No. 304.

Means is provided for forming a breakable vacuum-tight seal between the cylindrical member 238 and the heat cage 122, and consists of an annular ring 241 which is mounted on and secured to the exterior surface of the heat cage 122 and extending circumferentially therefrom. A plurality of balls 242 are provided between the ring 241 and the flanged cylindrical member 238 to minimize heat transfer from the heat cage 122 to the member 238. An additional removable ring seal 243 of stainless steel No. 304 is provided which is welded to the cylindrical member 238 and to the ring 241 to ensure the maintenance of a vacuum-tight seal between the cylindrical member 238, the ring 241 and the ring 242. As hereinafter explained, the ring-like seal 243 can be removed when it is desired to disassemble the tube, and new ring replaced when the X-ray tube is reassembled and reseded.

A ceramic plate 246 is carried by the forward extremity of the cylindrical member 238 and is spaced from the cross plate 121 which forms a part of the heat cage 122. The ceramic cross plate 246 is provided with an opening 247 through which the shaft assembly 36 extends.

A ring-like member 251 of stainless steel No. 304 is provided on the exterior of the heat cage 122 and within the cylindrical member 238, and serves to prevent expansion of the heat cage 122 so as to maintain good heat conducting contact with the cross plate 121.

The cylindrical member 236 forming part of the vacuum envelope means 216 is enclosed within insulating material. Thus, there is provided a layer 251 of a suitable insulating material such as Teflon (see FIG. 12). A wire 252 of a suitable material such as Nichrome is wound onto the insulating layer 251. The wires 252 are covered by another insulating layer 253 of a suitable material such as Teflon. A layer of lead 254 surrounds the insulating layer 253 and is disposed within the housing 23. A resistive network 261 (see FIG. 12) is connected to the Nichrome wires 252 and is comprised of a plurality of serially connected resistors 262, 263 and 264 which are connected to ground as shown. The resistors 262, 263 and 264 can have suitable values as for example 950, 40 and 10 ohms respectively. The wires 252 are connected to an arc suppressor 266 of a conventional type. The mid-points between the resistors 262, 263 and 264 are connected by leads 267 and 268 to a controller (not shown) of a conventional type to read the milliamperes of current flow in the tube envelope in a manner well know to those skilled in the art.

Anode and cathode feedthrough assemblies 271 and 272 are mounted in the ceramic end plate 237. Each feedthrough consists of a cup-shaped ceramic receptacle 273 with an insulating liner 274 formed of suitable material such as Teflon. The cup-shaped feedthroughs 271 and 272 are adapted to receive standard federal terminations and are each provided with three pins 276 of a conventional type. The anode pins 276 are connected by a lead 277 which is connected to a spring-like contact 278 engaging the shaft 106. The shaft 106 is coupled to the anode target 56 to supply a voltage to the anode target. The cathode pins 276 are connected to a cathode assembly 281 of a conventional type which creates electrons. The cross-plate 121 is provided with a circular undercut 282 which underlies the cathode assembly 281 to provide sufficient spacing from the cathode assembly while still providing a heat shield for the high voltage compartment. With the anode and cathode feedthroughs 271 and 272 therein. A hole 283 is provided in the undercut 282 through which the electrode from the cathode assembly 281 can pass to impinge upon the surface 57 of the anode target 56.

The cross plate is provided with an opening 286 through which the shaft assembly 36 extends. Rings 291 are mounted on the end plate 24 and are in alignment with the anode and cathode feed through 271 and 272. A window 296 (see FIG. 3) is provided for observing the x-ray tube 21. An opening 297 is provided in the end plate 24 for receiving an ion pump assembly if that is desired.

A window assembly 301 is provided in the x-ray tube construction 21 for permitting x-rays created by impingement of the electrons on the surface 57 to exit from the tube 21 and consists of an opening 302 provided in the heat cage 122 which is in alignment with the x-rays propagating from the surface 57. the window assembly 301 also includes a window 303 which is provided within the cylindrical member 236 forming a part of the vacuum envelope 216. The window 303 is in registration with the window 302. A very thin sheet as for example 0.002 inches of stainless steel No. 304 is mounted behind the window 203 and is bonded to the stainless steel cylindrical member 236 to form a vacuum tight seal. An opening 306 which is provided in the cylindrical member 238 to the rear of the window 303 and in alignment with the window 302. A plate-like member 307 formed of a material which will protect the stainless steel window sheet 304 from electron bombardment and also is sufficiently strong to provide a structural support for the sheet 304 so that it can withstand the vacuum within the vacuum envelope 216. Material to be found satisfactory for this purpose is boron nitride in a thickness as for example 0.040 inches. The boron nitride plate 307 is secured within the window 306 by suitable means such as short length of stainless steel wire of a suitable diameter such as 0.020 inches having a length of approximately one inch and are spaced apart and are spot welded to support the boron nitride plate in the window and in close proximity to the stainless steel sheet 304.

The ball bearing assemblies 37 and 38 hereinbefore described for supporting the shaft assembly are typically formed of a suitable high temperature alloy such as stainless steel No. 440. Such bearings should be suitable for many applications. However if higher temperatures are encountered, bearings formed of silicon nitride can be used. Such bearings can be lubricated with a lubricant capable of withstanding heat in a vacumn. Such a lubricant can be comprised of a gallium indium alloy (15% indium, 85% gallium) which becomes a liquid at 15 degree Centigrade to serve as a vehicle into which is mixed a lubricating powder to provide a lubricating paste. The lubricating powder can be boron nitride or graphite. This lubricant serves as a lubricant for the bearings. It also serves to conduct heat and electrical currents. Metalization can be provided on the bearing races to interface with the conducting lubricant to make possible conduction through the bearing.

Operation and use of the x-ray tube construction may now be briefly described as follows:

The x-ray tube 21 hereinbefore described can be utilized in a conventional manner for retrofit applications and new x-ray machinery. The construction shown makes it possible to operate the anode target 56 at high temperatures up to 2000 Degree Centigrade while keeping other components at temperatures within safe operating limits. The shaft construction permits expansion and contraction in radial and axial or longitudinal directions during heating and cooling. The anode target and the shaft assembly are maintained in intimate contact with each other during such heating and cooling by the use of the spring loaded three-point mountings. Each of the three balls of each set utilized in each of the three-point mountings has at least three points of engagement between the points of the mountings for a total of at least nine points for each set of three balls. In addition to providing good heat insulating capabilities because of the point contacts in the three-point or three-ball mountings, the mountings also facilitate centering and leveling of the anode target on the shaft assembly.

Figure 18:
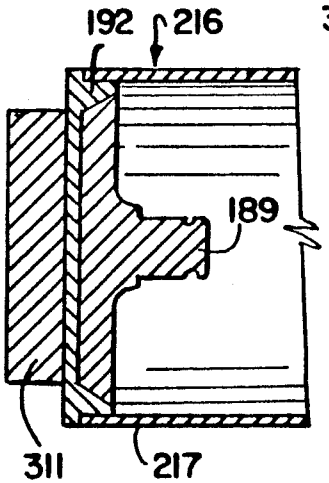
FIG. 18 is a partial cross-sectional view showing an alternative embodiment of a rotor cup construction in an x-ray tube construction incorporating the present invention.
Figure 17:
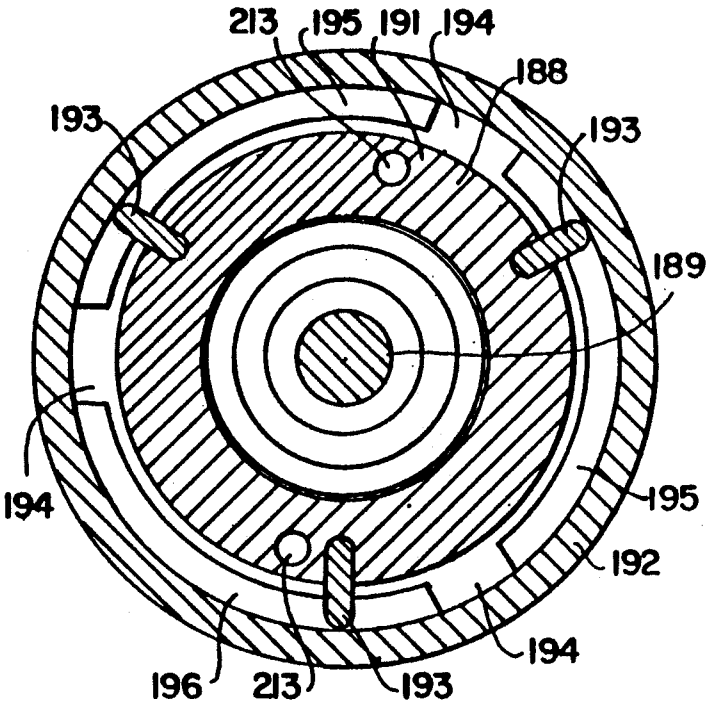
FIG. 17 is a cross-sectional view taken along the line 17—17 of FIG. 2.

Another embodiment of the x-ray tube construction incorporated in the present invention is shown in FIG. 18, which utilizes an alternative latching mechanism which incorporates a permanent magnet 311 secured to the end plate 192 to prevent inadvertent unlatching of the stud shaft 188. The permanent magnet 311 will serve to prevent rotation of the stationary stud shaft 188.

Figure 19:
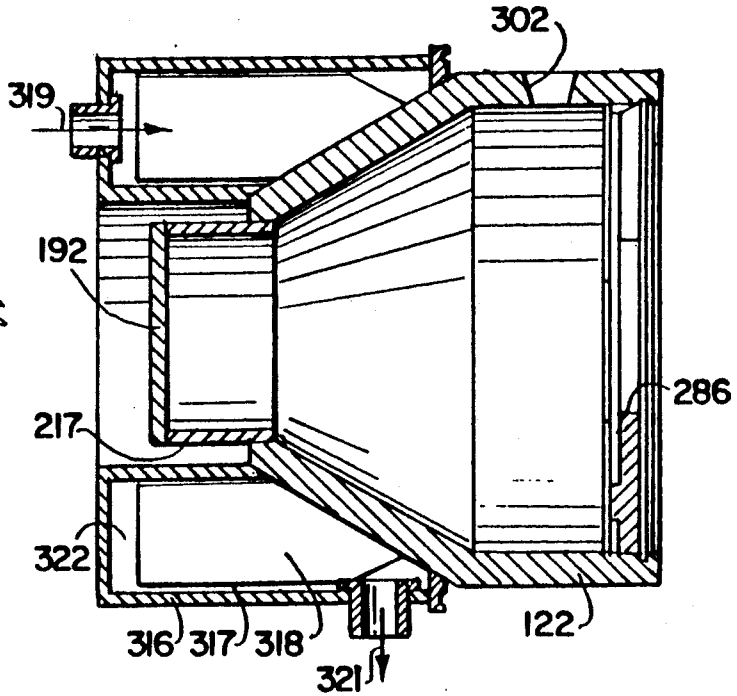
FIG. 19 is a partial cross-sectional view showing an x-ray tube construction incorporating the present invention which utilizes liquid cooling.

Still another embodiment of the x-ray tube construction incorporating the present invention is shown in FIG. 19, which shows a water-cooled embodiment. An annular water-tight housing 316 formed of a suitable material such as stainless steel is bonded to the heat cage 122 by suitable means such as brazing. An annular flow passage is provided which surrounds the heat cage 122. A plurality of radially extending fins 318 are provided within the annular space 317 and are secured to the heat cage 122 by suitable means such as brazing. The fins 318 can be formed of a suitable material such as stainless steel or aluminum. A water inlet 319 is connected to the annular housing 316 and is adapted to be connected to a suitable liquid conduit, as for example a hose which has a suitable liquid such as water under pressure therein which is supplied into the chamber 317. A liquid outlet 321 is provided at the other extremity of the chamber 317 and also is adapted to be connected to a suitable liquid conduit. The liquid can then be supplied to a appropriate chilling apparatus and then recirculated through fitting 319 to provide the desired cooling for the x-ray tube construction. It can be seen that the lower extremity of the fins 318 extend above the lower extremity of the chamber 317 to permit the liquid entering the fitting 319 to circulate freely beneath the vanes or fins 318 to rise relatively uniformly therein to come in contact with the fins or vanes and also in contact with the wall of the heat cage 122 to obtain maximum heat dissipation. The liquid can then flow through an annular passage 322 at the upper extremities of the fins 318 and to pass through the discharge outlet 321.

From the foregoing, it can be seen that an x-ray tube construction has been provided which has high power capabilities using air cooling which can be increased by utilizing liquid cooling. Very high anode temperatures can be accommodated because of the unique shaft construction, and also because of the unique three-point mounting provided between the anode and the shaft assembly. Also, it can be seen that a particularly novel means has been incorporated into the x-ray tube construction to facilitate assembly and to facilitate opening and repair of the same. Also, a particularly novel means have ben utilized for making it possible to easily center and level the anode target with respect to the shaft assembly. The shaft assembly has been constructed in such a manner so that it can readily accommodate expansion and contraction in a longitudinal direction upon heating and cooling of the x-ray tube. In addition, the x-ray tube construction is of a character which lends itself to high volume, low cost production.

What is claimed is:

1. In an x-ray tube construction, a housing, a shaft assembly mounted within the housing for rotational movement, an anode target, three-ball mounting means for mounting said anode target on said shaft assembly so that said anode target and said three-ball mounting means rotate with said shaft assembly, a cathode for supplying electrons disposed within the housing in the vicinity of said anode target, voltage means connected to the anode target and to the cathode for accelerating electrons from the cathode to impinge upon the anode target to create x-rays, said three-ball mounting means serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough.

2. A construction as in claim 1 wherein said three-ball mounting means includes at least one set of three balls spaced approximately 120° apart and providing only point contact through the three balls to inhibit the transmission of heat from the anode target to the shaft assembly.

3. A construction as in claim 2 wherein said balls are formed of a heat-stop material.

4. A construction as in claim 3 wherein said balls are formed of zirconia.

5. A construction as in claim 3 wherein said balls are formed of niobium.

6. A construction as in claim 1 wherein said shaft assembly includes an inner shaft and an outer shaft, linear bearing means disposed between the inner and outer shafts and permitting relative longitudinal movement between the inner and outer shafts.

7. A construction as in claim 6 wherein said inner shaft is comprised of two parts, one of the parts being formed of a metal and the other parts being formed of a ceramic and means for forming a bond between the ceramic part and the metal part.

8. A construction as in claim 1 together with first and second spaced apart bearing means for rotatably supporting said shaft assembly in said housing, said first and second bearing means including ceramic bearing members.

9. A construction as in claim 1 together with heat dissipating vanes mounted on said heat cage and cooling means in communication with said housing for directing a cooling fluid over said vanes.

10. A construction as in claim 9 wherein said cooling means includes a motor driven fan for directing air over said vanes.

11. A construction as in claim 9 wherein said cooling means includes means for supplying a cooling liquid over said vanes.

12. A construction as in claim 1 wherein said motor drive means includes an electric motor disposed outside of the vacuum envelope and magnetic means within the magnetically coupled to said electric motor and driven by the electric motor.

13. A construction as in claim 1 wherein said motor drive means includes a magnetic rotor mounted in the vacuum envelope and coupled to the shaft assembly, bearing support means mounted in the vacuum envelope and carrying said magnetic rotor and said shaft assembly for rotational movement with the housing, magnetic drive means mounted exterior of the vacuum envelope for driving said magnetic rotor and an electric motor driving said magnetic drive means.

14. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough, said three-balls mounting means including first and second sets of three balls each with the balls in each set being spaced 120° apart, first adjustment means disposed between the shaft assembly and the anode target and engaging said first set of balls for adjusting said anode target so that it is centered with respect to said shaft assembly and second adjustment means disposed between the shaft and the anode target engaging the second set of balls for leveling the anode target with respect to the shaft assembly.

15. A construction as in claim 14 wherein said first adjustment means includes a set of three adjustment eccentrics engaging said first set of balls.

16. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough, said three-ball mounting means for mounting said anode target on said shaft assembly including a base support member mounted within said anode target, a first set of three balls disposed between the shaft assembly and the base support and a second set of three balls disposed between the base support and the anode target, eccentric adjustment means carried by the base support and engaging the first set of balls for centering said anode target on said shaft and adjustable contact pins carried by the eccentric adjustment means and engaging the second set of balls for leveling said anode target with respect to said shaft.

17. A construction as in claim 16 wherein said shaft assembly includes an inner shaft and an outer hollow shaft, a linear bearing sleeve disposed between the inner shaft and the outer hollow shaft and carrying first and second longitudinally spaced apart sets of three balls each disposed between the inner shaft and the outer hollow shaft and permitting relative longitudinal movement of the inner shaft, the linear bearing sleeve and outer hollow shaft with respect to each other, pin and slot means securing said the outer hollow shaft to the inner shaft, said first set of balls of said three-point mounting means engaging the inner shaft, means for supporting said base support on said inner shaft and yieldable spring means disposed between inner and outer shaft and said linear bearing sleeve.

18. In an x-ray tube construction, a housing, a shaft assembly mounted within the housing for rotational movement, an anode target, three-ball mounting means for mounting said anode target on said shaft assembly so that said anode target rotates with said shaft assembly, a cathode for supplying electrons disposed within the housing in the vicinity of said anode target, voltage means connected to the anode target and to the cathode for accelerating electrons from the cathode to impinge upon the anode target to create x-rays, said three-ball mounting means serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough, said shaft assembly including an inner shaft and an outer shaft, linear bearing means disposed between the inner and outer shafts and permitting relative longitudinal movement between the inner and outer shafts, said inner shaft being comprised of two parts, one of the parts being formed of a metal and the other part being formed of a ceramic and means forming a bond between the ceramic part and the metal part, said means forming a bond between the ceramic part and the metal part including a cup-shaped portion carried by the metal part and having a cup-shaped recess therein, said ceramic part having a portion thereof extending into the cup-shaped recess and a material formed within the cup-shaped recess having a coefficient of expansion which is less than that of the ceramic and which is greater than that of the metal of the cup-shaped portion so that the portion of the ceramic part within the cup-shaped recess is maintained under compression during heating and cooling of the shaft assembly.

19. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough, a vacuum envelope mounted within a housing and serving to provide a vacuum tight enclosure for said anode target and said cathode, said vacuum envelope including window means in registration with the window in the heat cage to permit x-rays to pass therethrough, first and second spaced apart bearing means for rotatably supporting said shaft assembly in said housing, said first and second bearing means including ceramic bearing members and a bearing lubricant in contact with the ceramic bearing members, said bearing lubricant being comprised of an indium gallium vehicle having a lubricating powder dispersed therein.

20. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough, a vacuum envelope mounted within a housing and serving to provide a vacuum tight enclosure for said anode target and said cathode, said vacuum envelope including window means in registration with the window in the heat cage to permit x-rays to pass therethrough, and a cross plate mounted in said heat cage, said cross plate being formed of at least two parts and yieldable spring means engaging said two parts for yielding urging said two parts into intimate engagement with the heat cage to facilitate the transfer of heat from the cross plate to the heat cage.

21. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough, said motor drive means including a magnetic rotor mounted in the vacuum envelope and coupled to the shaft assembly, bearing support means mounted in the vacuum envelope and carrying said magnetic rotor and said shaft assembly for rotational movement with the housing, magnetic drive means mounted exterior of the vacuum envelope for driving said magnetic rotor and an electric motor driving said magnetic drive means, said bearing support means including an end plate forming a part of the vacuum envelope, a shaft plate, a shaft carried by the shaft plate, a bearing mounted on the shaft and engaging the magnetic rotor and releasable cooperative mating means carried by the shaft plate and the end plate permitting removal of the magnetic rotor, said shaft assembly and said anode target as a unit from the heat cage.

22. A construction as in claim 21 wherein said releasable cooperative mating means includes pin and recess means engagable and disengagable by rotational movement and means carried by said magnetic rotor for engaging said shaft plate for causing rotational movement thereof relative to said end plate whereby said cooperative means can be engaged and disengaged.

23. A construction as in claim 22 wherein said means carried by said magnetic rotor for engaging the shaft plate includes a plurality of pins extending through said rotor shaft and spring means engaging said plurality of pins for yieldably urging said pins away from said shaft plate and means accessible around said anode target and within said heat cage for engaging said plurality of pins to move said plurality of pins in a direction towards said shaft plate against the force of the spring means.

24. In an x-ray tube construction, a housing, a shaft assembly mounted within the housing for rotational movement, an anode target, three-ball mounting means for mounting said anode target on said shaft assembly so that said anode target rotates with said shaft, a cathode for supplying electrons disposed within the housing in the vicinity of said anode target, voltage means connected to the anode target and to the cathode for accelerating electrons from the cathode to impinge upon the anode target to create x-rays, said three-ball mounting serving to minimize the transfer of heat from anode target to the shaft assembly, motor drive means coupled to said shaft assembly for rotating the shaft assembly and the anode target carried thereby, a heat cage disposed within the housing and surrounding the anode target, said heat cage having a window therein to permit the x-rays to pass therethrough and a vacuum envelope mounted within a housing and serving to provide a vacuum tight enclosure for said anode target and said cathode, said vacuum envelope including window means in registration with the window in the heat cage to permit x-rays to pass therethrough, said shaft assembly including an inner shaft and an outer shaft, a linear bearing sleeve disposed between the inner and outer shafts, pin and slot means extending through the linear bearing sleeve and interconnecting the inner and outer sleeves, means connecting the linear bearing sleeve to the anode target, first fixed support means within the housing engaging the inner shaft, second fixed support means within the housing engaging the outer shaft and yieldable spring means engaging the linear bearing sleeve and the outer shaft permitting relative longitudinal movement between the linear bearing sleeve and the outer shaft to accommodate the expansion and contraction of the inner and outer shafts and the linear bearing sleeve during heating and cooling of the x-ray tube.

25. A construction as in claim 24 wherein said linear bearing sleeve is provided with two longitudinally spaced sets of three balls each spaced 120° apart.

26. In an x-ray tube construction, a vacuum envelope disposed within the housing, a shaft assembly disposed within the vacuum envelope, an anode target disposed within the vacuum envelope and mounted on said shaft assembly for rotation therewith, a cathode for supplying electrons disposed within the vacuum envelope in the vicinity of the anode target, voltage means connected to the anode target and to the cathode for accelerating electrons from the cathode to impinge upon the anode target to create x-rays, said vacuum envelope including window means to permit x-rays to pass therethrough, bearing support means mounted in the vacuum envelope, a magnetic rotor mounted in the vacuum envelope and coupled to the shaft assembly, bearing support means mounted within the vacuum envelope and mounting said magnetic rotor and said shaft assembly for rotational movement within the vacuum envelope, magnetic drive means mounted exterior of the vacuum envelope for driving said magnetic rotor and an electric motor driving said magnetic drive means, said bearing support means including a shaft plate disposed within the vacuum envelope, a shaft mounted on the shaft plate, bearing means mounted on the shaft plate and engaging the magnetic rotor, magnetic means disposed exterior of the vacuum envelope and applying magnetic forces to said bearing support means to retain said bearing support means in engagement with said shaft but permitting removal of the magnetic rotor, said shaft assembly and said anode target as a unit from within the vacuum envelope.

* * * * *